US006726519B2

(12) United States Patent
Suzuki et al.

(10) Patent No.: US 6,726,519 B2
(45) Date of Patent: Apr. 27, 2004

(54) MANUFACTURING METHOD FOR A PLASMA DISPLAY PANEL, A PLASMA DISPLAY PANEL, AND A PHOSPHOR INK APPLYING DEVICE

(75) Inventors: Shigeo Suzuki, Hirakata (JP); Hiroyuki Kawamura, Katano (JP); Keisuke Sumida, Hirakata (JP); Nobuyuki Kirihara, Hirakata (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/302,676

(22) Filed: Nov. 22, 2002

(65) Prior Publication Data

US 2003/0076038 A1 Apr. 24, 2003

Related U.S. Application Data

(62) Division of application No. 09/857,672, filed as application No. PCT/JP00/07223 on Oct. 18, 2000, now Pat. No. 6,503,116.

(30) Foreign Application Priority Data

Oct. 19, 1999 (JP) ..... 11-296314

(51) Int. Cl.[7] ..... H01J 9/227

(52) U.S. Cl. ..... 445/24; 445/52; 427/10; 427/68

(58) Field of Search ..... 445/24, 58, 52; 427/68, 10; 313/582–587

(56) References Cited

U.S. PATENT DOCUMENTS

| | | | | |
|---|---|---|---|---|
| 6,249,264 | B1 * | 6/2001 | Sano et al. | 313/582 |
| 6,508,687 | B2 * | 1/2003 | Suzuki et al. | 445/24 |
| 6,511,145 | B1 * | 1/2003 | Tsuboi et al. | 347/14 |
| 6,547,617 | B1 * | 4/2003 | Kawamura et al. | 445/24 |

FOREIGN PATENT DOCUMENTS

| | | |
|---|---|---|
| JP | 63155527 | 6/1988 |
| JP | 8257466 | 10/1996 |
| JP | 10223138 | 8/1998 |
| JP | 10228863 | 8/1998 |
| JP | 11213896 | 8/1999 |
| JP | 11239748 | 9/1999 |

* cited by examiner

*Primary Examiner*—Kenneth J. Ramsey

(57) ABSTRACT

The object of the present invention is to provide a phosphor ink applying device that can apply phosphor ink in a plurality of lines to an intricately-shaped surface of a back panel of a PDP while preventing phosphor colors mixing.

A valve is provided for the aperture of each nozzle of the phosphor ink applying device and the opening and closing of each valve is controlled according to the shape of the portion of the surface to which ink is to be applied. In this way, mixing of colors can be prevented on an intricately-shaped back panel such as that with auxiliary barrier ribs.

27 Claims, 9 Drawing Sheets

MANUFACTURING METHOD FOR A PLASMA DISPLAY PANEL, A PLASMA DISPLAY PANEL, AND A PHOSPHOR INK APPLYING DEVICE

RELATED APPLICATIONS

This is a divisional application of Ser. No. 09/857,672 filed Oct. 9, 2001, now U.S. Pat. No. 6,503,116, which is the national stage filing of PCT/JP 00/07223 filed on Oct. 18, 2000.

TECHNICAL FIELD

The present invention relates to a color display device used in televisions or computers for image display, and in particular a plasma display panel having phosphor films, a method of manufacturing therefor, and a phosphor ink applying device for use when applying the phosphor film.

BACKGROUND ART

Among various types of color display devices used for displaying images on computers or televisions, Plasma Display Panels (PDPs) have become a focus of attention as color display devices that enable large-size, slimline panels to be produced.

PDPs display in full color according to an additive process of the so-called three primary colors (red, green, and blue). In order to perform this full color display, a PDP is composed of stripe-shaped barrier ribs interposed between a front panel and a back panel, and a phosphor film between each barrier rib that emits light in one of the colors red (R), green (G), and blue (B). Images are displayed by phosphor particles which form the phosphor film being excited by ultra violet rays generated in discharge cells of the PDP. This produces visible light in the colors.

Japanese Laid Open Patent Application H10-27543 discloses a method for forming such phosphor film. In this method, a phosphor ink applying device is used, and ink is continuously discharged from a plurality of nozzle apertures which are provided in a row with a distance therebetween of three times the pitch between each barrier rib. By moving the nozzle over the PDP platform, a plurality of lines of phosphor are applied simultaneously to the grooves between the barrier ribs.

According to this method, phosphor ink is continuously applied to the grooves, resulting in phosphor particles being formed evenly in the lines. Furthermore, applying a plurality of lines simultaneously means that not only can variations between the amount of ink applied to each line be controlled, but also that the amount of time required to apply the phosphor is reduced and work efficiency is improved.

Technical Problem

In recent years techniques have been developed to improve brightness of PDPs by making the barrier ribs meandering rather than straight lines, or by providing auxiliary barrier ribs at predetermined intervals in the grooves between the barrier ribs (for example, see Japanese Laid-Open Patent Application H10-321148). Here, the auxiliary barrier ribs are lower than the barrier ribs.

FIG. 9 is a perspective view of barrier ribs and auxiliary barrier ribs. As shown in this figure, barrier ribs 1*a*, 1*b*, and 1*c* are formed in striped shapes with intervals therebetween, and auxiliary barrier ribs 2*a* and 2*b*, and 2*c* and 2*d* are formed in the grooves in the intervals between the barrier ribs 1*a* and 1*b*, and 1*b* and 1*c* respectively. Discharge spaces 3*a* and 3*b* are formed in the spaces between each barrier rib and auxiliary barrier rib.

Taking the discharge space 3*a* as an example, phosphor film is formed on side walls 4 and 5 (the side wall 5 is not visible in the diagram) of the auxiliary barrier ribs 2*a* and 2*b*, respectively. As a result, the light emitting area is larger than when auxiliary barrier ribs are not provided, because of the extra area of the side walls, meaning that the brightness of the PDP is improved.

However, when phosphor ink is applied to a back panel which has such auxiliary barrier ribs using the conventional phosphor ink application described earlier, the phosphor ink discharged through the nozzle apertures is applied successively parallel to the barrier ribs by moving the PDP in relation to the phosphor ink applying device. However, this gives rise to a problem in which, for instance, ink applied to the top portion 6 of the auxiliary barrier rib 2*a* flows over the barrier ribs 1*a* and 1*b* into the adjacent discharge spaces which emit light of a different color, causing the colors to mix. This problem can also occur in portions between barrier ribs where the gap is narrow in back panels which have meandering barrier ribs. A PDP cannot perform full color display if such color mixing occurs.

DISCLOSURE OF THE INVENTION

In view of the above-described problem, the object of the present invention is to provide a phosphor ink applying device and a method for manufacturing a PDP for applying phosphor ink in a plurality of lines to an intricately-shaped surface of a back panel of a PDP while preventing phosphor colors mixing, and a PDP formed using the phosphor ink applying device and the method of manufacturing.

In order to achieve the object, the present invention is a phosphor ink applying device for applying phosphor ink in a plurality of parallel line-shapes to a surface of a work according to movement in relation to the work, including a plurality of tanks for storing fed-in phosphor ink, a plurality of nozzle members, each nozzle member having one nozzle aperture which is linked to a storage chamber of one of the tanks, a moving unit for moving the nozzle members in relation to the surface, a pressuring unit for applying pressure to the phosphor ink stored in the tanks so as to discharge the phosphor ink through the nozzle apertures, and a control unit for individually controlling a discharge quantity of phosphor ink discharged through each nozzle aperture, according to a shape of a portion of the surface to which the phosphor ink is to be applied.

According to this structure the discharge quantity of phosphor ink which each nozzle aperture discharges can be controlled individually, even when the portion to which phosphor ink is to be applied is intricately-shaped, therefore phosphor ink can be applied in a plurality of line-shapes simultaneously. This means that when phosphor ink is applied to a substrate of a plasma display panel which has auxiliary barrier ribs, the amount of ink which is applied to the top of the auxiliary barrier ribs can be controlled to be less than that applied to other places. As a result, color mixing due to phosphor ink flowing over barrier ribs can be prevented. Furthermore, the discharge quantity from each nozzle can be controlled, so phosphor ink is only applied where necessary, even if the positions of the nozzles are misaligned in the movement direction relative to the surface. In other words, there is much freedom in the positioning of the nozzles.

Furthermore, if each nozzle member includes a discharge quantity varying unit for varying the discharge quantity through each nozzle aperture, and the control unit controls the discharge quantity of the phosphor ink through each nozzle aperture according to the shape of the portion of the surface to which the phosphor ink is to be applied by driving each discharge quantity varying unit individually, an appropriate quantity of phosphor ink can be applied where necessary even to an intricately-shaped surface.

Furthermore, the pressuring unit may include an applied pressure varying unit for each tank for varying the pressure applied to the phosphor ink, and the control unit may control the discharge quantity of the phosphor ink through each nozzle aperture according to the shape of the portion of the surface to which the phosphor ink is to be applied, by driving each applied pressure varying unit individually.

Furthermore, the phosphor ink applying device of the present invention is for applying phosphor ink in a plurality of parallel line-shapes to a surface of a work, including one or more tanks for storing fed-in phosphor ink, a plurality of nozzle members, each nozzle member having one nozzle aperture linked to a storage chamber of one of the tanks, a moving unit for moving the nozzle members in relation to the surface, a pressuring unit for applying pressure to the phosphor ink stored in the tanks so as to discharge the phosphor ink through the nozzle apertures, a discharge quantity varying unit being provided for each nozzle aperture and varying a discharge quantity of phosphor ink to which pressure is applied, and the control unit controlling the discharge quantity of the phosphor ink through each nozzle aperture according to the shape of the portion of the surface to which the phosphor ink is to be applied, by driving each discharge quantity varying unit individually.

According to this structure, when phosphor ink is applied to a substrate of a plasma display panel in the same manner as described above, mixing of colors can be prevented. In addition, a plurality of nozzle apertures are provided for one tank, meaning that the number of tanks can be reduced and the phosphor ink applying apparatus can be made compactly.

Here, if the nozzles are positioned misaligned in the direction of relative movement, phosphor ink can be applied with the distance between adjacent line-shaped phosphor ink shortened.

Furthermore, the discharge quantity varying unit can be used as a flow path resistance unit for varying the discharge quantity by varying the flow path resistance of the phosphor ink through the nozzles. Specifically, a valve can be used as the discharge quantity varying unit.

A specific example of the object to which phosphor ink is applied is a substrate for a plasma display panel.

Furthermore, the moving unit includes a slideable table for carrying a substrate of a plasma display panel that has the barrier ribs provided in a row, and each nozzle is provided above the grooves formed between the barrier ribs of the substrate for the plasma display panel carried by the moving table. Therefore, phosphor ink can be applied in the grooves of the substrate carried by the table, in parallel, in accordance with the movement of the moving table.

Furthermore, the method of the present invention for manufacturing a plasma display panel, is a method including an ink application process for applying to a substrate for a plasma display panel which has (a) a plurality of first barrier ribs provided so grooves are formed therebetween, and (b) second barrier ribs which are provided at a predetermined interval in the grooves and which have a height lower than the first barrier ribs, phosphor ink in a line shape parallel to the first barrier ribs in each groove successively, and including, in the ink application process, the quantity of phosphor ink applied to walls of the second barrier ribs being less that the quantity of phosphor ink applied to areas between the second barrier ribs. According to this structure, flow of the phosphor ink applied to the gaps between the second barrier ribs over the first barrier ribs can be suppressed, meaning that color mixing on the substrate can be suppressed.

Furthermore, the plasma display panel of the present invention is formed with a substrate which has (a) a plurality of first barrier ribs provided so grooves are formed therebetween, (b) second barrier ribs which are provided at a predetermined interval in the grooves and which have a height lower than the first barrier ribs, and (c) line-shaped phosphor film parallel to the first barrier ribs formed in each groove successively, and the phosphor film is applied more thinly to a top portion of the second barrier ribs than to the areas therebetween. Color mixing during driving display can be suppressed in such a plasma display panel.

BEST MODE FOR CARRYING OUT THE INVENTION

First Embodiment

The following explains an embodiment of a phosphor ink applying device to which the present invention is applied, with reference to the drawings.

<Structure of a PDP>

The following explains the structure of a PDP 100, during the manufacturing of which phosphor ink is applied by a phosphor ink applying device.

Figure 1:
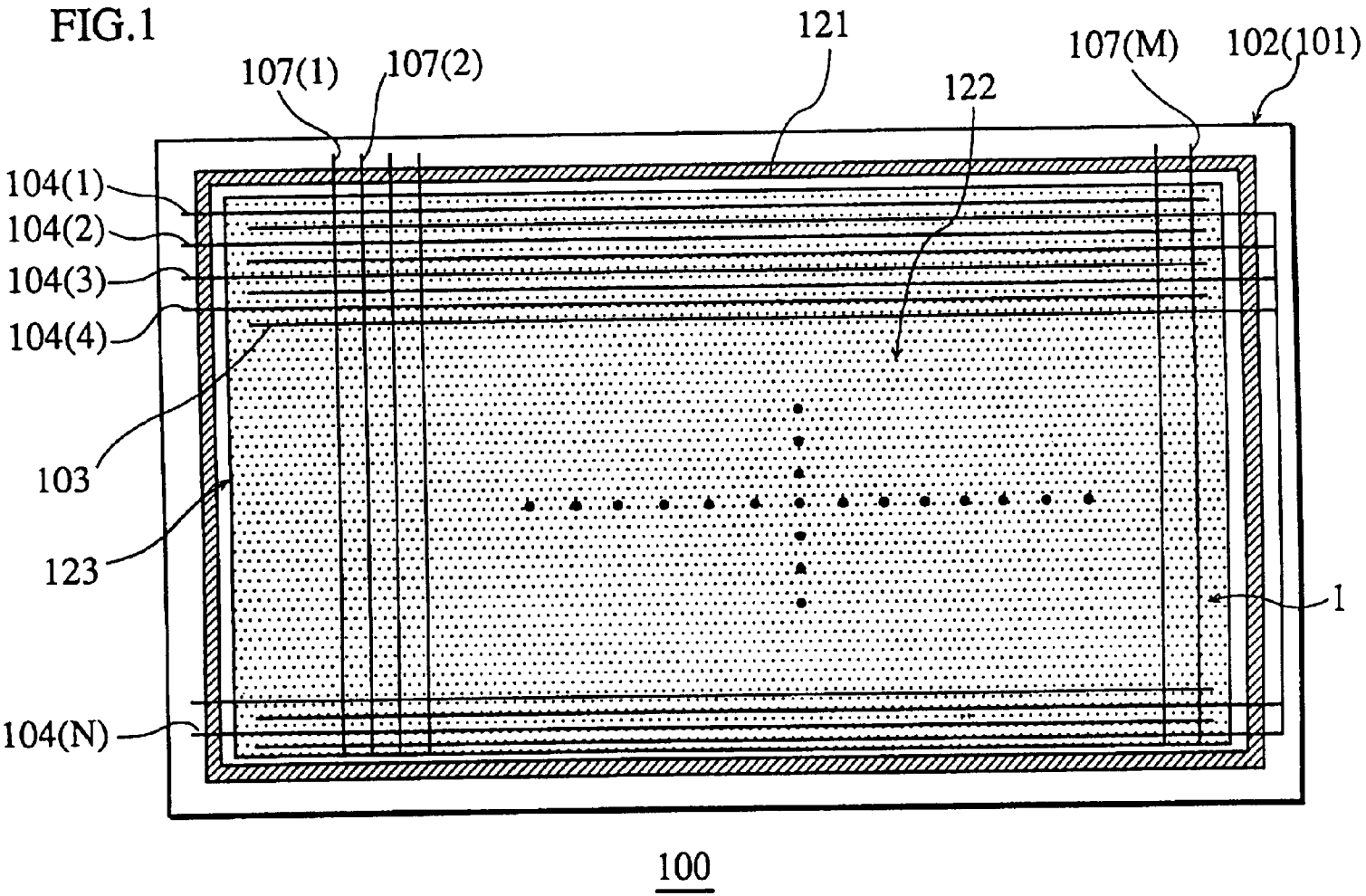
FIG. 1 is a plan view of a PDP from which a front glass substrate has been removed.
Figure 2:
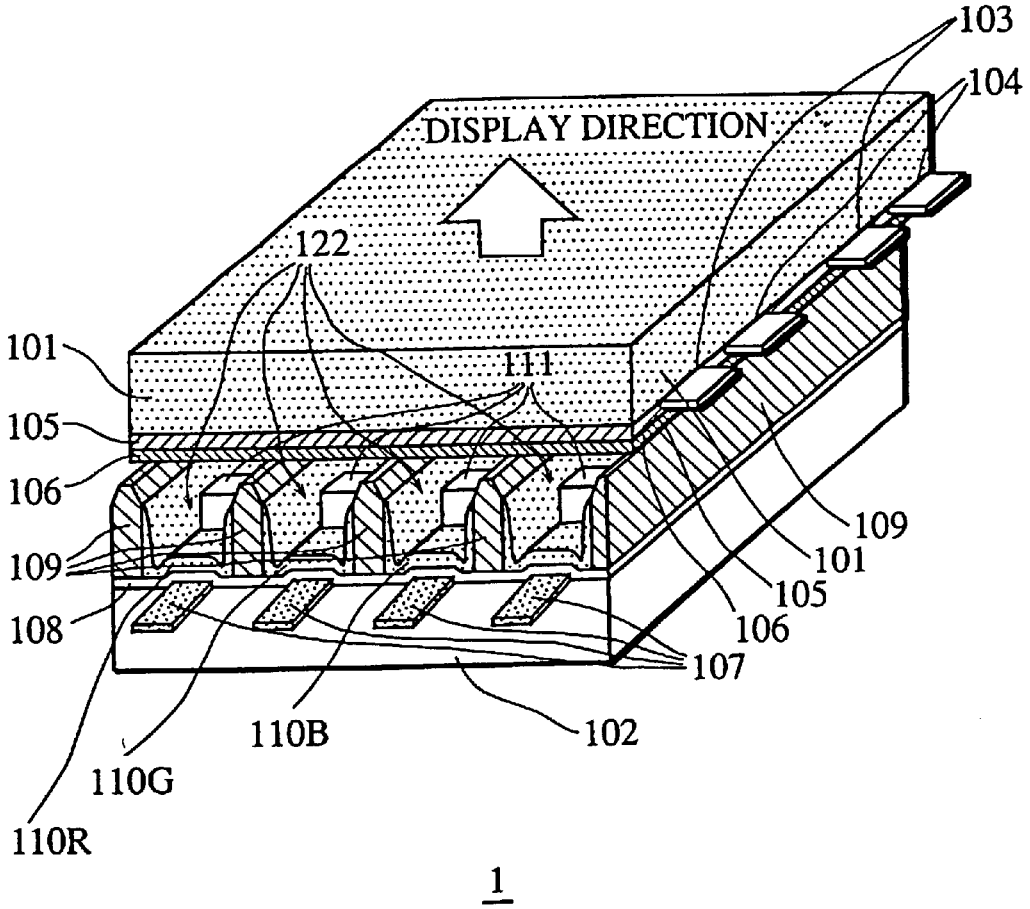
FIG. 2 is a partial perspective and sectional view of the PDP.

FIG. 1 is a plan view of a the PDP 100 from which a front glass substrate 101 has been removed, while FIG. 2 is a partial perspective and sectional view of the PDP 100. Note that in FIG. 1 some display electrodes 103, display scan electrodes 104, and address electrodes 107 are omitted for simplicity's sake. The construction of the PDP 100 is explained using these diagrams.

In FIG. 1, the PDP 100 is made up of a front glass substrate 101 (not illustrated), a back glass substrate 102, N display electrodes 103, N display scan electrodes 104 (please note that a number is extra to 'N' to express the 'Nth' electrode), M address electrodes 107 (please note that a number is extra to 'M' to express the 'Mth' electrode), and a hermetic sealing layer 121 which is shown by diagonal lines. The electrodes 103, 104, and 107 together form a matrix of a three-electrode structure. The areas where the display scan electrodes 104 intersect with the address electrodes 107 are cells.

In the PDP 100, as shown in FIG. 2, a front panel and a back panel are placed parallel to each other with a gap therebetween. The front panel is composed of a front glass substrate 101 on which the display electrodes 103, the display scan electrodes 104, a dielectric glass layer 105, and an MgO protective layer 106 are arranged on one main surface. The back panel is composed of a back glass substrate 102 on which the address electrodes 107, a dielectric layer 108, barrier ribs 109, auxiliary barrier ribs 111, and phosphor films 110R, G, and B are arranged on a main surface. The gap between the panels is divided by stripe-shaped barrier ribs 109, and gaps between the barrier ribs are further divided by trapezoid auxiliary barrier ribs 111 which are formed in the groove between each barrier rib 109. In the groove between each barrier rib 109, a discharge space 122 which includes the wall surfaces of the auxiliary barrier ribs 111 and in which red, green, and blue phosphor film is formed, and discharge gas is sealed therein.

Figure 3:
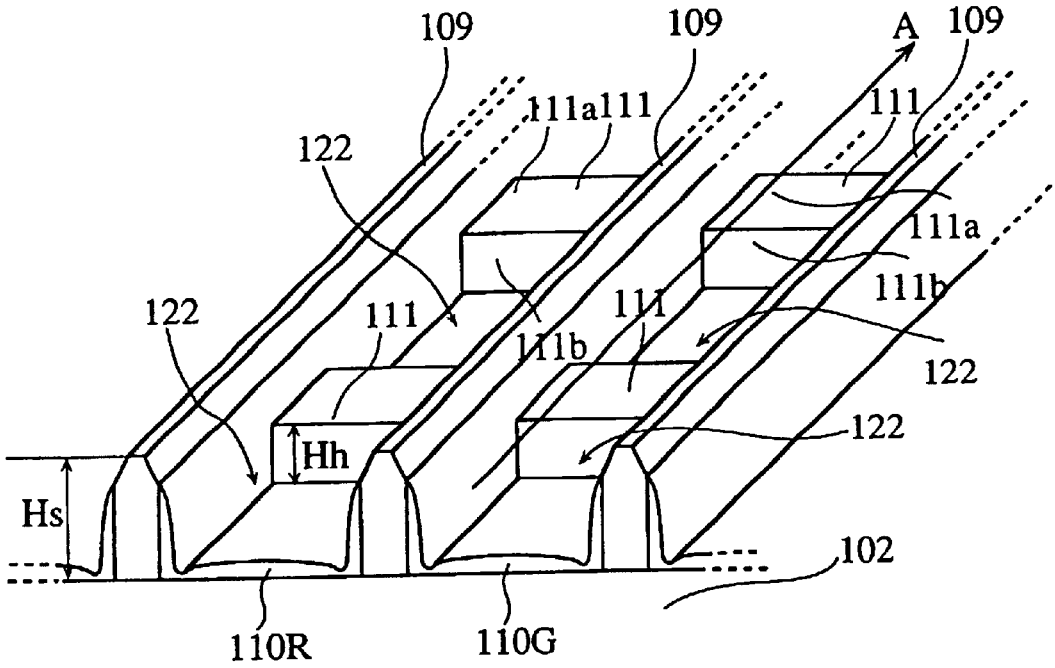
FIG. 3 is a partial perspective and sectional view of the PDP to show the structure of the barrier ribs and the auxiliary barrier ribs.

FIG. 3 is a partial perspective and sectional view of a PDP from which the front panel has been removed to show the structure of the barrier ribs 109 and the auxiliary barrier ribs 111. As shown in the figure, discharge cells 122 are formed between the adjacent stripe-shaped barrier ribs 109 and the auxiliary barrier ribs 111 therebetween. These areas are unit cells, and each cell is separated.

The auxiliary barrier ribs 111 are formed so as to have a height Hh from the back glass substrate 102 (including the dielectric layer 108) that is lower than a height Hs of the barrier ribs 109 from the back glass substrate 102. A phosphor film is also formed on the top portion 111*a* and the side surface portion 111*b* of each auxiliary barrier rib 111. As a result, the light emitting area is larger than when auxiliary barrier ribs are not provided, because of the extra area of the side walls, meaning that the brightness of the PDP 100 is superior to a PDP which does not have auxiliary barrier ribs.

The PDP 100 is connected to and driven by a PDP driving device which is not illustrated. When the PDP 100 is being driven, a driver circuit, a display scan driver circuit, and an address driver circuit which are not illustrated are connected. In order to illuminate the PDP 100, pulse voltage is applied to the display scan electrodes 104 and the address electrodes 107, and after address discharge is performed therebetween, pulse voltage is applied between the display scan electrodes 104 and sustained discharge is performed. According to the sustained discharge, ultra-violet rays are generated in the appropriate cells, and the phosphor particles excited by these ultra-violet rays emit light. This causes the cell to be illuminated, and images are displayed by combinations of each cell either being illuminated or not.

<Method for Manufacturing the PDP 100>

Next, a method for manufacturing the above-described PDP 100 will be explained with reference to FIG. 1 and FIG. 2.

1. Manufacturing of the Front Panel

The front panel is manufactured by first forming n display electrodes 103 and display scan electrodes 104 (in FIG. 2 only two of each are shown) alternatively so as to be parallel in stripe shapes, covering the result with a dielectric glass layer 104, and then forming an MgO protective layer 106.

The display electrodes 103 and the display scan electrodes 104 are made of silver, and are formed by applying electrode silver paste by screen printing and then firing the result.

The dielectric layer 105 is made to a predetermined thickness (approximately 20 $\mu$m) by applying a paste which includes lead glass by screen printing, then baking the result for a predetermined amount of time at a predetermined temperature (for example, 20 minutes at 560° C.). As an example of the paste which includes lead, a mixture of, for instance, PbO (70 wt %), $B_2O_3$ (15 wt %), $SiO_2$ (10 wt %), $Al_2O_3$ (5 wt %), and an organic binder (10% of ethyl cellulose dissolved in α-terpineol) is used. The organic binder is a substance obtained by dissolving a resin in an organic solvent. A resin such as an acrylic resin and an organic solvent such as butyl carbitol may be used instead of etyle cellulose and α-terpineol. Also, a dispersant (for example glycertrioleate) maybe mixed into the organic binder.

The MgO protective layer 106 is made from magnesium oxide (MgO), and is formed to a predetermined thickness (approximately 0.5 $\mu$m) by, for instance, sputtering, or CVD (chemical-vapor deposition).

2. Manufacturing of the Back Panel

First, a silver paste is applied to the surface of the back glass substrate 102 by screen printing, and then the result is fired to form the m address electrodes 107 in alignment. Then, a paste containing lead glass is applied to the surface of the back glass substrate 102 to form the dielectric layer 108. Next, a paste containing the same kind of lead glass substance is repeatedly applied in a predetermined pitch to the surface of the dielectric layer 108 by screen printing, and the result is fired to form the barrier ribs 109 and the auxiliary barrier ribs 111.

Once the barrier ribs 109 and the auxiliary barrier ribs 111 have been formed, each color of phosphor ink is applied by a phosphor ink applying device (explained later) as the green phosphor ink in FIG. 3 is applied in a direction of an arrow A in a predetermined cell. The phosphor ink is a paste adjusted to an appropriate viscosity (for example, 0.1 to 100 Pa.s (100 to 100000 CP)) and is composed from red (R), green (G), or blue (B) phosphor particles, an organic binder, a dispersant, a solvent, and so on. The phosphor particles can be those used generally in PDP phosphor films.

The following is a specific example:

Red phosphor: $(YxGd_{1-x})BO_3:Eu^{3+}$ or $YBO_3:Eu^{3+}$

Green phosphor: $BaAl_{12}O_{19}:Mn$ or $Zn_2SiO_4:Mn$

Blue phosphor: $BaMgAL_{10}O_{17}:Eu^{2+}$

Phosphor ink which uses this kind of phosphor particles is applied to the top portions and the side wall portions of the auxiliary barrier ribs 111, but the amount of ink applied to these portions is set according to an application method, which will be described later, to be relatively less than that applied to other portions. This prevents mixing of inks of different color cells.

Next, the result is fired at 400 to 590° C., and the organic binder is burnt away, resulting in the phoshor particles being fixed to the substrate and the phosphor films 110R, 110G, and 110B being formed.

3. Manufacturing of the PDP by Sealing the Panels Together

The front panel and back panel manufactured as described above are laminated so that the electrodes of the front panel intersect at right angles with the address electrodes of the back panel. Sealing glass is interposed between the front and back panels along their edges, and the result is fired at-a temperature of around 450° C. for 10 to 20 minutes to form the airtight hermetic sealing layer 121 (FIG. 1). As a result, the front and back panels are sealed together. Once the inside of the discharge spaces 122 has been exhausted to form a high vacuum (for example, $1.1\times10^{-4}$ Pa), a discharge gas (for example and inert gas of He—Xe or Ne—Xe) is enclosed in the discharge spaces 122 at a certain pressure. This completes the PDP 100.

<Structure of the Phosphor Ink Applying Device>

Next, the phosphor ink applying device used when applying phosphor paste to the back panel will be explained.

Figure 4:
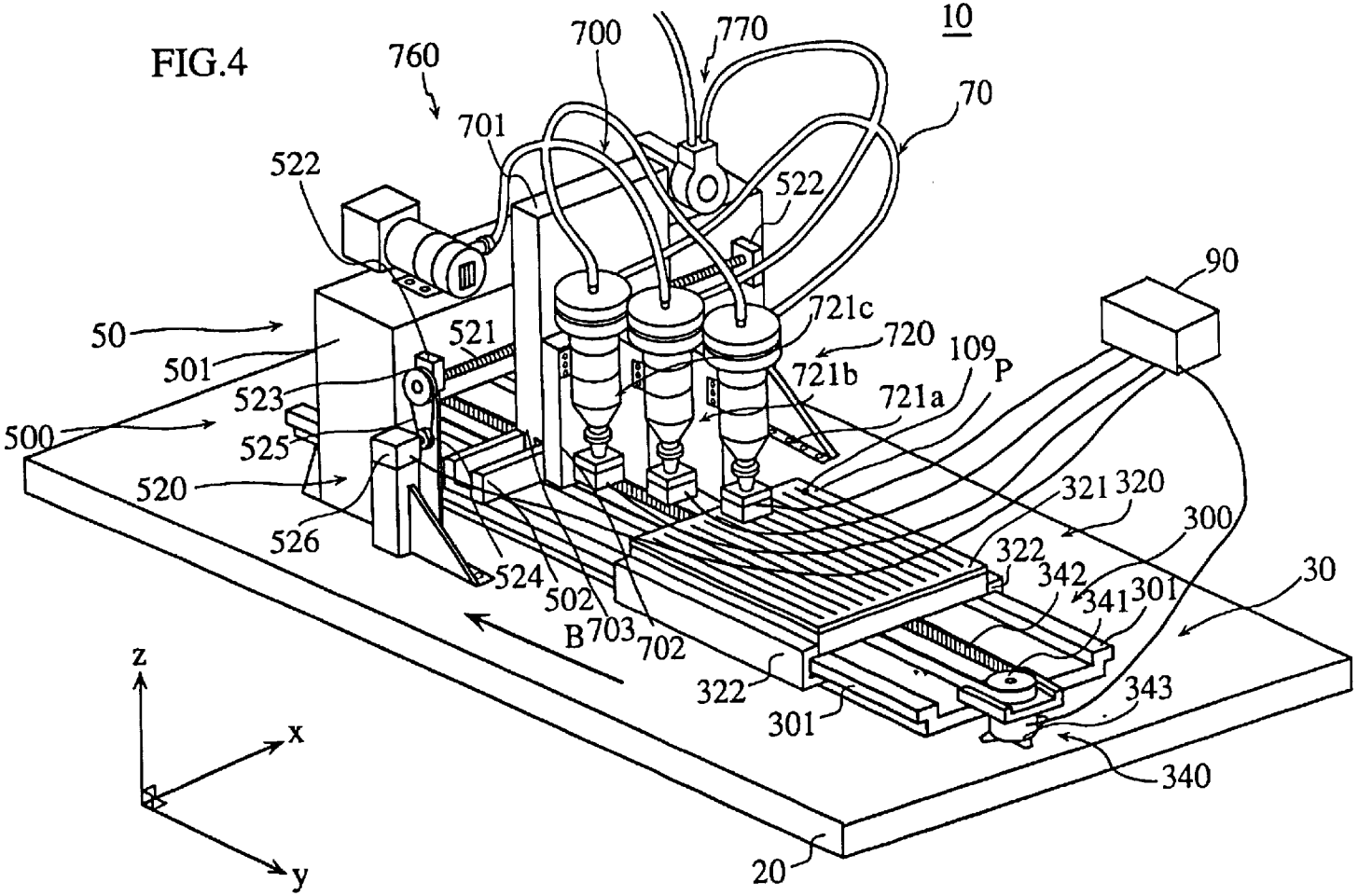
FIG. 4 is a perspective view of the phosphor ink applying device.

FIG. 4 is a perspective view of the overall structure of a phosphor ink applying device 10. Please note that the angles at which phosphor ink discharge devices 721*a, b*, and *c* are arranged along the y-axis are exaggerated to aid understanding.

As shown in the drawing, the phosphor application device 10 is composed of a moving table unit 30 which moves over a base 20, an ink discharging unit 70 which is fixed by a discharge device moving unit 50, and a controller 90. The phosphor application device 10 applies ink which is discharged by the ink discharging unit 70 by moving the moving table unit 30 at a constant speed over the PDP back panel.

<Moving Table Unit 30>

The moving table unit 30 carries the back panel P on which barrier ribs and auxiliary barrier ribs are formed (These barrier ribs and auxiliary ribs are not illustrated in FIG. 4, however, the barrier ribs 109 are formed in an along the y-axis.), and holds the back panel P moveably along the y-axis for applying the phosphor. The moving table unit 30 is composed of a base 300, a platform 320 and a driver 340.

The base 300 has opposing rails 301, and is positioned so as to move along the y-axis. The rails 301 fit together with guides 322 of the platform 320 to hold the platform 320 slideably along the y-axis.

The platform 320 carries the back panel P, and is composed of a moving table 321, and guides 322. The moving table 321 is a flat plate. The guides 322 have C-channel-shaped cross sections, and are provided on either side of the moving table 321 along the x-axis. The platform 320 slides back and forth along the y-axis according to the working of the belt of the driver by being partly linked to the belt.

The driver 340 is composed of pulleys 341, a belt 342, and a driving motor 343. The belt 342 is strung around the opposing pulleys 341 (only one of which is visible in the figure), and at least one of the pulleys is rotatably supported by the driving motor 343. A pulse motor is an example of the type of motor used. The platform 320, which is linked to the belt 342, moves back and forth along the y-axis according to the rotations of the motor being precisely controlled.

<Discharge Device Moving Unit 50>

The discharge device moving unit 50 holds the ink discharging unit 70 to be moveable back and forth along the x-axis, and is composed of a supporter 500 and a discharge device driving unit 520.

The supporter 500 is composed of a support base 501, and a discharge unit supporter 502. The support base 501 fixes the discharge unit supporter 502 and is itself fixed to the base 20. The discharge unit supporter 502 is a guide which has a C-channel-shaped cross section and the hollow thereof and the support base 701 of the ink discharging unit 70 fit together to hold the ink discharging unit 70 to be moveable back and forth along the x-axis.

The discharge device driving unit 520 holds-the ink discharge unit 70 to be moveable back and forth in the x-axis, and is composed of a rotating rod 521, a holder 522, pulleys 523 and 524, a belt 525, and a driving motor 526. The rotating rod 521 is provided with a screw groove. The holder 522 holds the rotation rod 521 rotatably. The pulleys 523 and 534 are provided at one end of the rotating rod 521 and on the rotating axis of the driving motor 526, respectively, to transfer rotation. The driving motor 526 drives the pulley 524, and the belt 525 which is strung between the pulleys 523 and 524.

The rotating rod 521 is rotated via the pulley 524, the belt 525, and the pulley 523 according to the driving of the driving motor 526. The male groove of the revolving rod 521 screws together with a female thread portion (not illustrated) provided on the supporter 701, and screwing action which occurs due to the revolutions of the driving motor 526 allows mobility of the ink discharging unit 70 back and forth along the x-axis. Here, when the driving of the driving source of the driving motor 526 can be accurately controlled, such as with a pulse motor, the position of the driving source on the x-axis can be measured from the driving amount, by providing a basic position sensor such as a optical position sensor (for example a CCD camera), which detects when the motor passes a basic position on the x-axis.

<Ink Discharge Unit 70>

The ink discharge unit 70 discharges phosphor ink between each barrier rib 109 of the back panel P, and is composed-of a supporter 700 and an ink discharge device 720.

The supporter 700 is composed of support bases 701 and 702. The support base 701 supports the ink discharge unit 70 overall, while the support base 702 is fixed by the support base 701 and supports the ink discharge device 720.

The support base 701 is a flat plate which has a protruding portion 703 on one end. The protruding portion 703 fits together with the discharge unit supporter 502 described earlier, holding the support base 701 moveably along the x-axis.

The support base 702 is stepped-shaped, having three linked steps, each of which has a different length on the y-axis. Each of the steps supports one of the phosphor ink discharge devices 721*a, b*, and *c*. According to this structure, the phosphor ink discharge devices 721*a, b*, and *c* are fixed at a predetermined angle and so as to line up diagonally in relation to the y-axis (misaligned in the movement direction of the moving table 321). The distance along the x-axis between the phosphor ink discharged by each phosphor ink discharge device is three times the distance between barrier ribs (about 160$\mu$ to 360 $\mu$m). The reason for the distance being three times is that the same color of phosphor ink is applied at three times the pitch between the barrier ribs. By placing the phosphor discharge devices misaligned along the y-axis, the apparaus can be designed so that the distance between the barrier ribs is adjustable and can be set to be closer.

The ink discharge device 720 is composed of phosphor ink discharge devices 721*a, b*, and *c*, a pressuring device 760 for applying pressure to discharge ink, and a delivery pump 770 for delivering phosphor ink to the phosphor ink discharge devices. Phosphor ink that is delivered by the delivery pump is stored in the phosphor ink discharge devices 721*a, b*, and *c*, and is forced out by pressure from the pressuring device 760.

Air compressors and so on are used in the pressuring device 760 to supply air at a constant pressure. In addition, a pump such as a plunger pump or a gear pump which can deliver viscous paste is used as the delivery pump 770.

Please note that the driving motor 343 of the moving table unit 30, the driving motor 526 of the supporter 500, and a valve driver 754 (which will be explained later) of the ink discharge device 70 are controlled by operations of the controller 90. The controller 90 is composed of CPU, a memory, and an operator input unit (a keyboard for instance), which are not illustrated. Phosphor ink applying operations, which will be explained later, are executed based on a control program stored in the memory according to the driving of the driving motors 343 and 526, and the valve driving unit 754.

<Structure of the Phosphor Ink Discharge Devices 721*a, b*, and *c*>

The following is an explanation of the phosphor ink discharge devices 721*a, b*, and *c* which have a structure which characterizes the present invention. Please note that as each of the devices have the same structure, the phosphor ink discharge device 721*a* will be used as an example.

Figure 5:
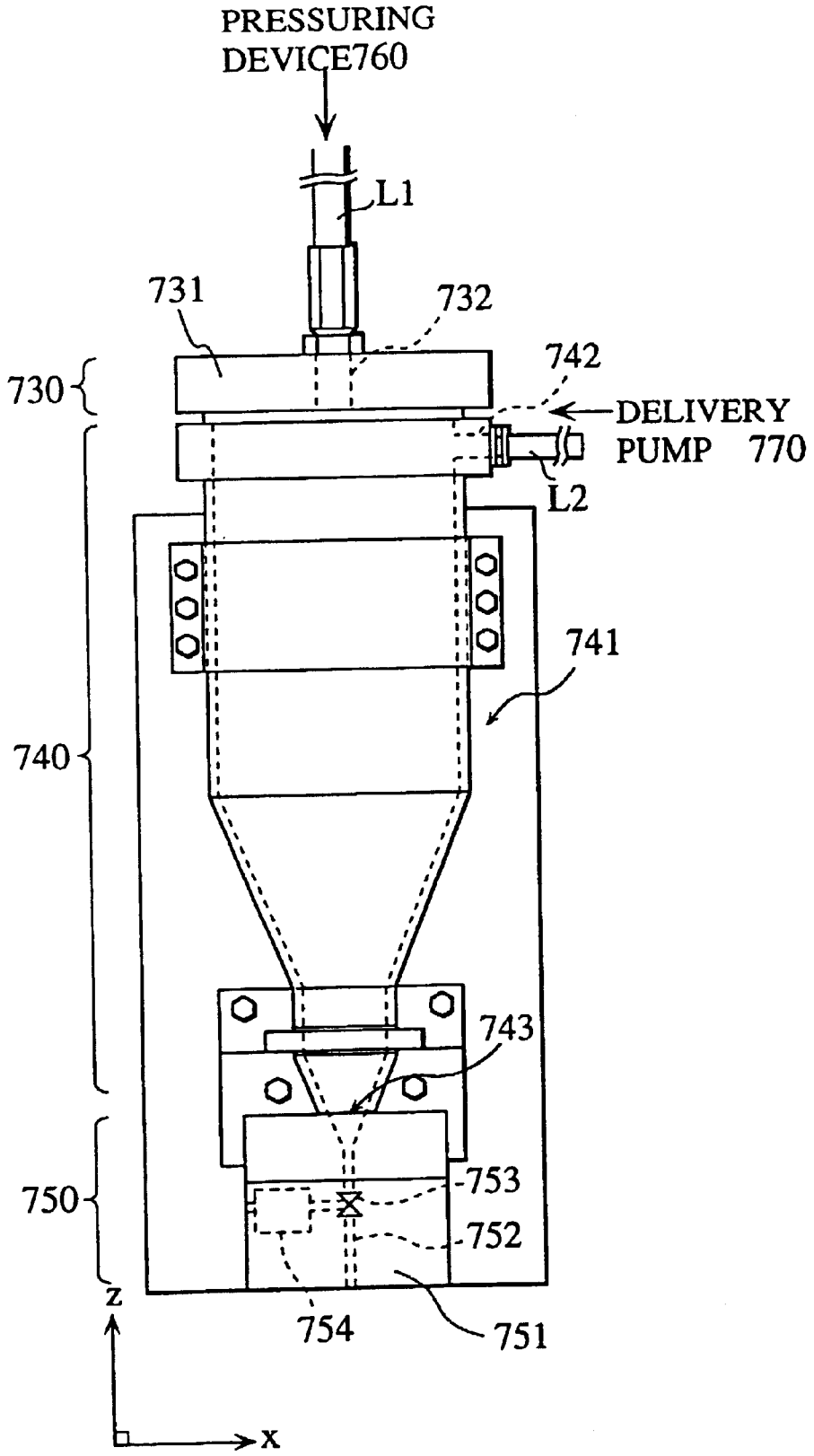
FIG. 5 is a front view of a phosphor ink discharge device.

FIG. 5 is a front view of the overall structure of the phosphor ink discharge device 721*a*. In order to explain the internal structure some ordinarily non-visible portions are shown by broken lines.

In the figure, the phosphor ink discharge device 721*a* is composed of a lid member 730, a tank member 740, and a nozzle member 750.

The lid member 730 is composed of a stainless steel plate member 731, and an induction mouth 732 is provided in the center of the main surface thereof for compressed air which is sent from the pressuring device 760. The phosphor ink discharge device 721*a* is linked the pressuring device 760 by a line L1 which brings the compressed air to the induction mouth 732. Please note that the plate member 731 is sealed and fastened with screws by packing, which are not illustrated.

The tank member 740 is composed of a tank 741 which is manufactured by grinding processing of stainless steel material. An induction mouth 742 is provided on the top of one side of the tank 741. The induction mouth 742 and the delivery pump 770 are connected by a line L2. Phosphor ink that is sent from the delivery pump 770 is stored in the tank 741 through the line L2 which is connected to the induction mouth 742. Please note that an outlet 743 is provided at the other end of the tank 741. Phosphor ink stored in the tank 741 is successively delivered to the nozzle member 750 according to the pressure of the compressed air via the outlet 743.

The nozzle member 750 discharges, in a predetermined narrowness, phosphor ink that is sent from the tank member 740, and is composed of a square member 751, a nozzle aperture 752, a valve 753, and a valve driver 754. The nozzle aperture 752 is formed in along the z-axis by making an opening through the square member 751. The valve 753 is provided partway along the nozzle aperture 752 and is for varying the discharge quantity of the phosphor ink. The valve driver 754 drives the opening and closing of the valve 753.

The square member 751 has a space for disposing the nozzle aperture 752, and the valve 753 partway along the nozzle aperture 752. In addition, the valve 753 is mounted in the square member 751 so as to be linked with the nozzle aperture 751.

The nozzle aperture 752 is a stainless steel material (for instance SUS304) which is shaved on a lathe so as to make a cylindrical aperture, and is subjected to a mirror surface processing according to electrolytic polishing so that friction resistance of phosphor ink that flows through is reduced to a minimum. The diameter of the nozzle aperture 752 is normally set at about 45$\mu$ to 150 $\mu$m which is narrower than the distance between barrier ribs 109 (approximately 160$\mu$ to 360 $\mu$m).

The valve 753 uses, for example, a needle valve and an air pressure control valve (both manufactured by SMC Corporation), and these valves are opened and closed by the driving of the valve driver 754. By controlling the opening and closing subtly, the flow path resistance of the phosphor ink which passes through the nozzle aperture 752 varies, meaning that the discharge quantity can be controlled.

The valve driver 754 controls the valve 753 subtly to open and close the valve 753.

According to the above-described construction, pressure is applied by compressed air being provided through the line L1 to phosphor ink provided through the line L2, the phosphor ink is discharged through the nozzle aperture 751, and the discharge quantity can be varied according to the opening and closing of the valve.

Please note that here that lines branch out to each of the phosphor ink discharge devices 721*a, b*, and *c* from one pressuring device 760 and one delivery pump 770 to supply phosphor ink, but a pressuring device 760 and a delivery pump 770 may be provided for each of the phosphor ink discharge devices 721*a, b*, and *c*, in which case branching out of lines would be unnecessary.

<Method of Applying Phosphor Ink>

Next, a detailed explanation will be given of a process of applying phosphor ink to the back panel using a phosphor ink applying device having the above-described structure.

1. Settings of the Phosphor Ink Applying Device

Returning to FIG. 4, various settings of the phosphor ink applying device will be described.

First, in order to carry the back panel, the driving motor 343 is controlled, so that the moving table 321 is put in a position in which its end is aligned with the ends of the rails 301 (in a direction towards the front of the drawing).

Then, the back panel on which barrier ribs 109 and auxiliary barrier ribs 111 have been already formed is mounted horizontally on the moving table 321 so as to be in a predetermined position and so that the barrier ribs 109 are parallel to the y-axis. The back panel is industrially produced and has barrier ribs and auxiliary barrier ribs formed in predetermined positions, therefore it is considered that when the back panel is mounted on the moving table 321 that there will be barrier ribs and auxiliary barrier ribs in the predetermined positions. In other words, information about such things as the positions and shapes of the barrier ribs and the auxiliary barrier ribs is input beforehand through the operator input unit of the controller, so the positions of the barrier ribs and auxiliary barrier ribs when on the moving table 321 are already set.

Here, the positions of the barrier ribs and auxiliary barrier ribs can measured and revised if the surface of the back panel is formed having one or more positioning marks and the phosphor ink discharge device has an optical sensor to detect the marks. Alternatively, the optical sensor can be made to detect the barrier ribs and the auxiliary barrier ribs themselves, rather than the marks. The optical sensor can be, for example, a CCD camera or a laser displacement gauge.

Next, the discharge quantity from the nozzles of the phosphor ink discharge devices 721*a, b*, and *c* is made to be constant by adjusting the pressure of the pressuring device 760 and the quantity delivered by the discharge pump 770, through the operator input unit. Here, there is a danger that variations will occur in the discharge quantity from the phosphor ink discharge devices due to errors when the device is started up. In such cases, the quantity of phosphor ink discharged from the phosphor ink discharge devices is measured over a set period of time and the variations are calibrated by adjusting the opening and and closing of the valves.

Next, the speed conditions of the application process, in other words, conditions such as the speed at which the moving table 321 moves (the rotating speed of the driving motor 343) and the color of the phosphor to be applied (between which barrier ribs the phosphor will be applied) are set. This completes the various settings of the phosphor ink applying device.

2. Beginning Application of Phosphor Ink

After the various settings of the phosphor ink applying device are completed, the operator inputs an operation through the operator input unit to start the work, and the application of the phosphor ink starts automatically.

FIG. 4 will be used in the following explanation. The moving table 321 progresses at a fixed speed in an indicated by an arrow B, according to the driving motor 343 rotating at a fixed speed. Then, when the position on the back panel where phosphor ink is to be applied is directly below the nozzle of the phosphor ink discharge device 721*a*, the valve 753 of the phosphor in discharge device 721*a* is opened, and application of phosphor ink starts. As the position of the barrier ribs and auxiliary barrier ribs of the back panel are input beforehand, the timing at which the valve is opened can be determined by corresponding these positions to the position of the moving table 321 (the number of rotations of the driving motor 343).

Application of phosphor ink by the phosphor ink discharge devices 721*b* and 721*c* begins in the same manner. Furthermore, the timing of the start of discharge of the phosphor ink discharge devices 721*a*, 721*b*, and 721*c* is staggered because of their differing positions along the y-axis.

3. Control of Phosphor Ink Discharge Quantity

If the set discharge quantity used when application of phosphor ink begins is maintained in the same way as described above, there is a possibility that phosphor ink applied on the tops of the auxiliary barrier ribs may flow over the barrier ribs into adjacent different colored cells, and cause mixing of colors. Consequently, the discharge quantity of phosphor ink is controlled.

Figure 6:
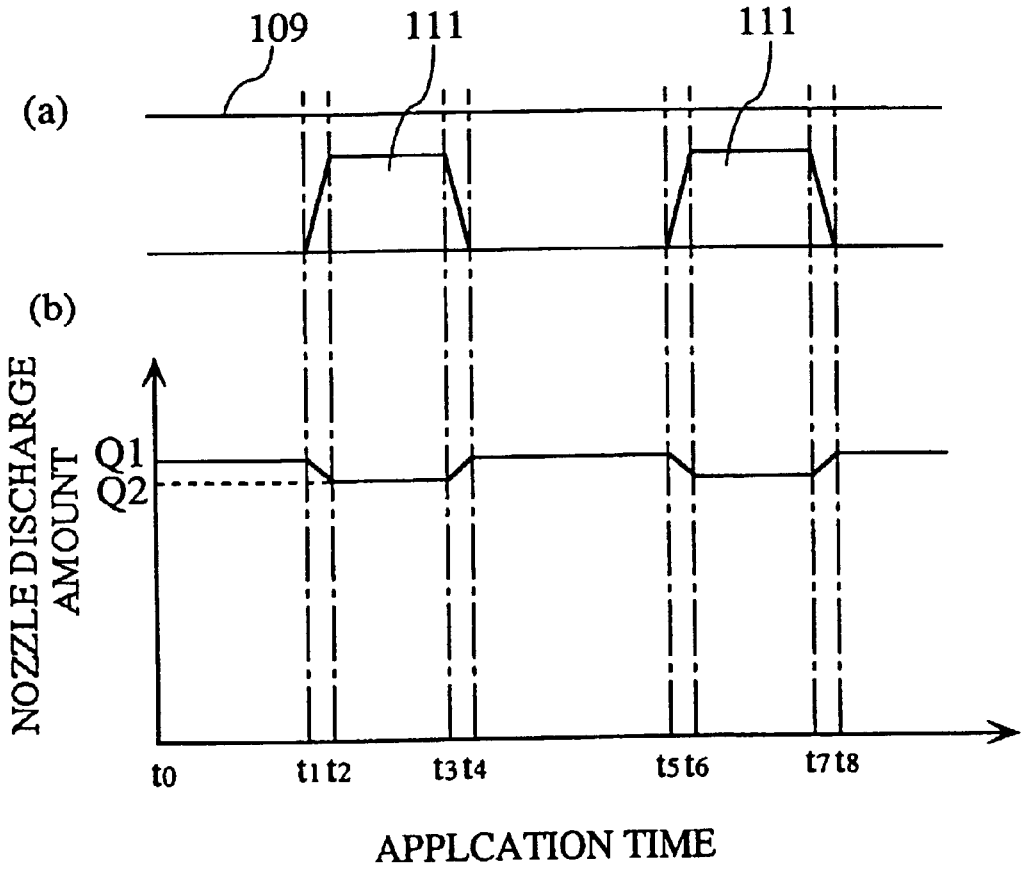
FIG. 6 is a time chart showing the control method of an ink discharge quantity of the phosphor ink discharge device.

FIG. 6 explains a method of controlling the phosphor ink discharge quantity over time when phosphor ink is applied in an shown by the arrow A in FIG. 3. FIG. 6(*a*) shows the correspondence between application time (the distance the back panel moves) and the undulations made by the auxiliary barrier ribs 111 in the direction of arrow A in FIG. 3. FIG. 6(*b*) shows the relationship between the application time and the discharge quantity from the phosphor ink discharge device.

As shown by the figures, there is no auxiliary barrier rib in the area to which phosphor ink is being applied during the time t0 to t1. In this section the valve 753 is fully open and a predetermined discharge quantity of phosphor ink Q1 is consistently maintained and applied.

Next, during the time t1 to t2, application of phosphor ink to a side wall of the auxiliary barrier rib begins. At this time, the discharge quantity of phosphor ink is gradually reduced to a quantity Q2.

During time t2 to t3, phosphor ink is applied to the top portion of an auxiliary barrier rib. The discharge quantity is already reduced to Q2 at t2, and Q2 consistently maintained while application takes place. In this way, flow into the adjacent cells of phosphor ink which has been applied over the barrier ribs 109 is prevented. The discharge quantity Q2 is set within a range that will not overflow, taking the height Hs of the barrier ribs 109 and the height Hh of the auxiliary barrier ribs 111 into consideration.

Next, phosphor ink is again applied to a side wall of the auxiliary barrier rib during time t3 to time t4. Here, the discharge quantity is gradually increased from Q2 to Q1. This means that at time t4 the discharge quantity has returned to Q1, and phosphor ink can be applied consistently maintaining the discharge quantity Q1 to the ensuing area in which there is no auxiliary rib.

This kind of operation is repeated for areas which have barrier ribs from t5 onwards, and is finished when phosphor ink has been applied to a length equal to that of one barrier rib. When application finishes the valve 753 is closed, stopping discharge. By having the three phosphor ink discharge devices 721*a*, 721*b*, and 721*c* perform identical operations three lines of phosphor ink can be formed by scanning once.

Next, the moving table 321 is moved in the opposite direction to arrow B (see FIG. 4) so as to be in line with the rails 301, and the driving motor 526 is driven and moves the support base 701 along the x-axis a distance that is nine times the pitch of each barrier rib 109 (that is, the pitch of neighboring same phosphor colors (three times the pitch of the barrier ribs) multiplied by the number of phosphor ink discharge devices (three)).

By repeating the above-described application of phosphor ink, the application of one color of phosphor ink is completed. Other colors are applied to the back panel in the same manner.

According to the above-described method, color mixing that occurs when applied phosphor ink flows over into adjacent cells can be prevented because the discharge quantity of phosphor ink to auxiliary barrier ribs is reduced. Furthermore, as described above, by providing a valve in each nozzle aperture of the phosphor ink discharge devices and a driving device to drive the valves, it is possible to control the phosphor ink discharge amount by controlling the driving device. Therefore, phosphor ink can be applied without mixing colors, even in a back panel which is intricately shaped such as that having auxiliary ribs, and a plurality of lines of phosphor ink can be applied simultaneously. As a result work efficiency is improved. Furthermore, as described above, the placements of the phosphor ink applying devices 721*a*, 721*b*, and 721*c* are staggered in the y-axis, but the discharge timing can be controlled for each nozzle, so a result, phosphor ink can be applied only where necessary.

Please note that in a PDP formed through such an application process, phosphor films are formed thinly of surfaces of the auxiliary barrier ribs (the tops and side walls), and thickly in other places (the areas between auxiliary barrier ribs in the grooves formed by the barrier ribs).

<Variations of the Present Embodiment>

The above-described phosphor ink applying device is described as having a group of three ink discharge devices. However, if there are as many ink discharge devices positioned in a line as there are lines of a color to be applied to a PDP, one color can be applied by scanning only once, further improving work efficiency.

Figure 7:
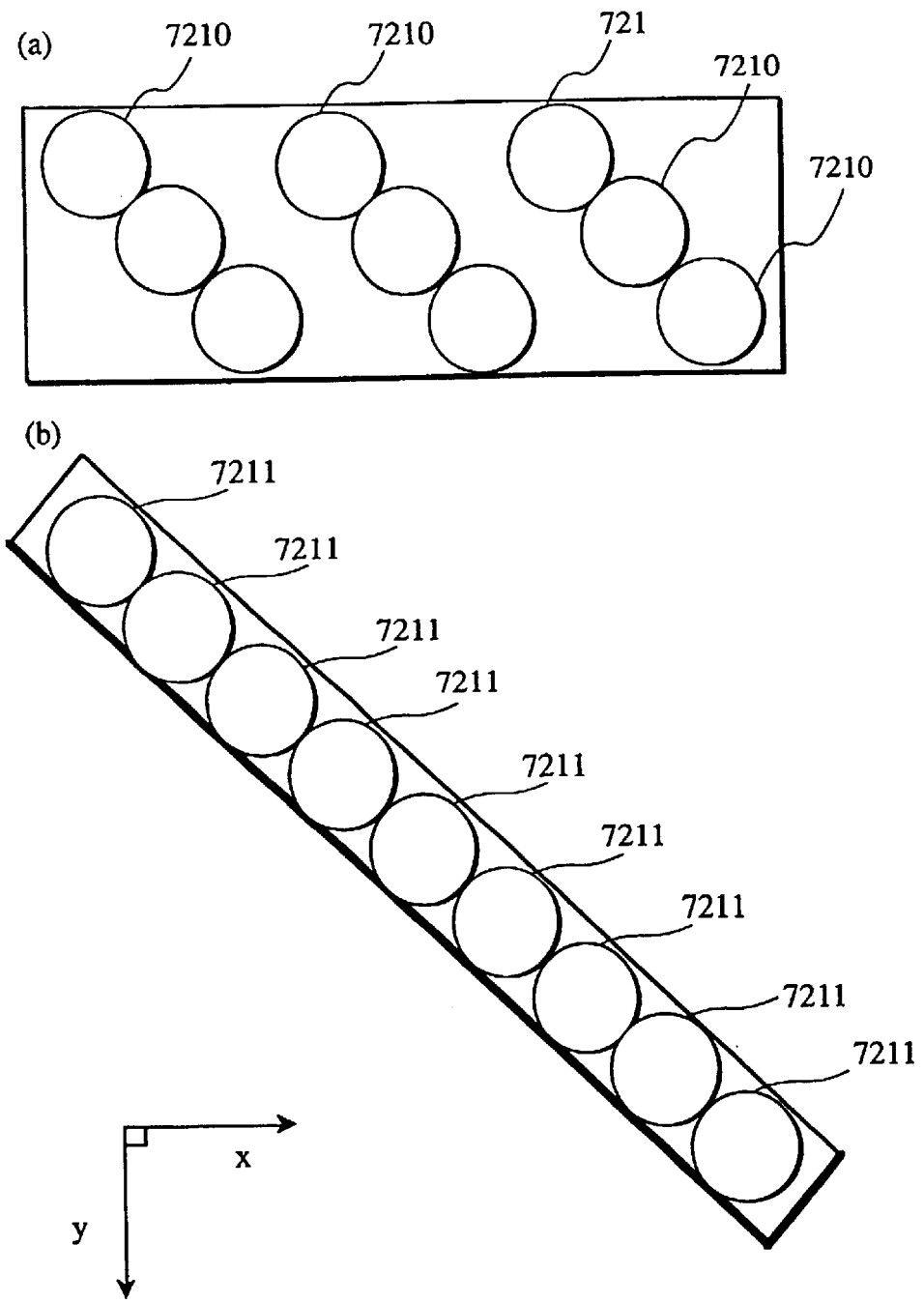
FIG. 7 is an outline view showing the arrangement of the ink discharge devices in a variation of the first embodiment.

FIG. 7 shows an outline of an arrangement of ink discharge devices when the phosphor ink applying device is seen along the a z-axis. For example, a plurality of ink discharge devices 7210 such as that described above may be arranged in groups of three in an x-axis, such as in FIG. 7(*a*), or all ink discharge devices 7211 may be positioned in a row diagonal in relation to the y-axis, such as in FIG. 7(*b*).

Furthermore, in the embodiment, an example of a back panel which has auxiliary barrier ribs was explained, but the phosphor ink applying device of the present invention can be applied to a back panel which does not have auxiliary barrier ribs, but rather has meandering barrier ribs, the distance between which varies relatively. In such a back panel, overflow may occur in narrow sections between barrier ribs if phosphor ink is applied at a constant discharge quantity, meaning that colors may mix. Such color mixing can be controlled if the present invention is used to reduce the discharge quantity when the distance between barrier ribs is short, and increase the discharge quantity when the distance between barrier ribs in long.

In the above described embodiment, valves are used as the means for changing the discharge quantity of phosphor ink. However, it is possible to provide a device such as a regulator which controls output pressure, for example partway along the line L2 which is connected to each ink discharge device from the pressuring device 760 shown in FIG. 5, provide a driving device to drive the regulator, and have the driving device controlled by the control unit. The result is that by adjusting the output pressure, in other words the pressure applied to the ink discharge devices, the discharge quantity from each nozzle aperture is controlled for each ink discharge device. In addition, a heating and cooling device may be provided in the nozzle member instead of a valve. The temperature of the nozzle member varies according to the driving of the ink discharge device, meaning that the viscosity of phosphor ink passing through the nozzle aperture also changes, changing the discharge quantity.

Second Embodiment

Next, a second embodiment of the phosphor ink applying device to which the present invention is applied will be explained. Please note that the phosphor ink application device of the present embodiment has substantially the same structure as that shown in FIG. 4 and FIG. 5, except for the nozzle member 750 of the first embodiment shown in FIG. 5. Therefore, the following will focus on the differences.

Figure 8:
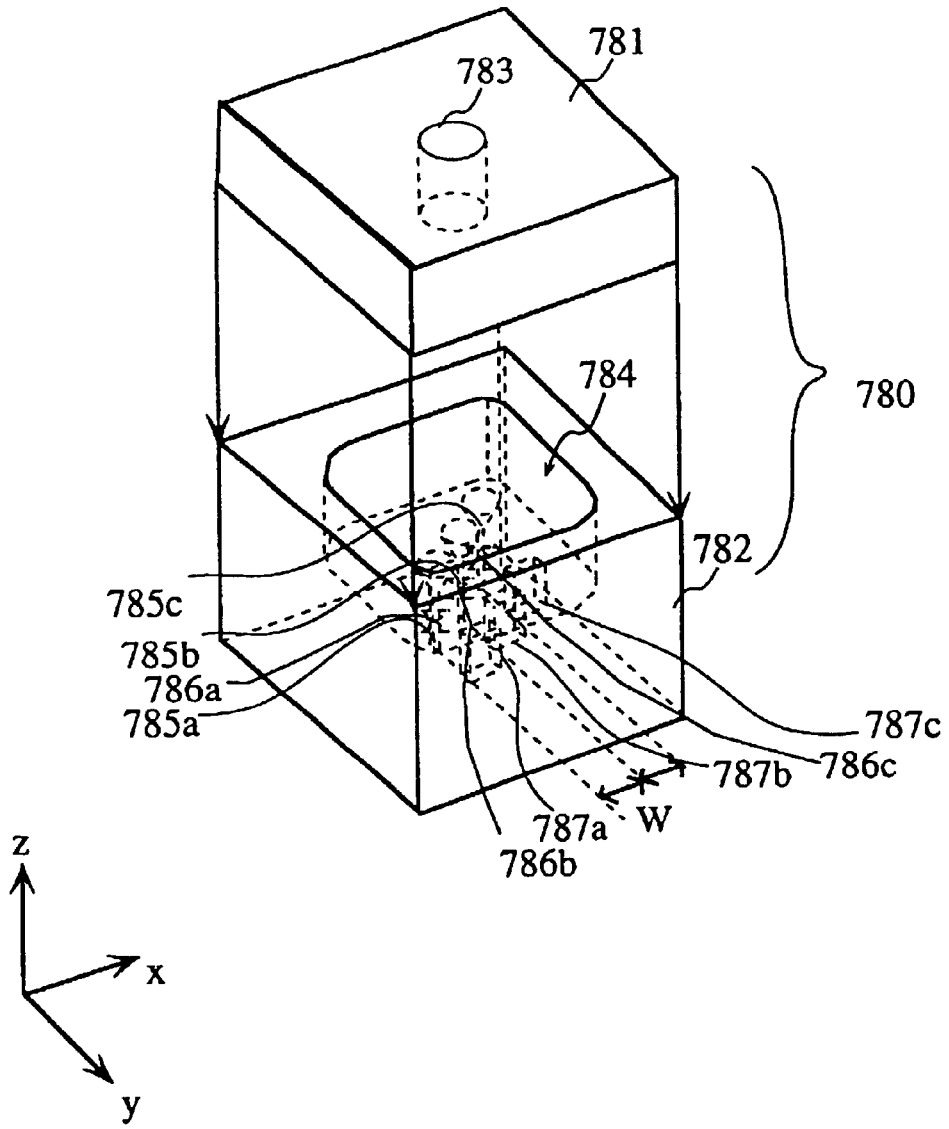
FIG. 8 is a partial perspective and sectional view of the structure of the nozzle member of the phosphor ink discharge device of the second embodiment.
Figure 9:
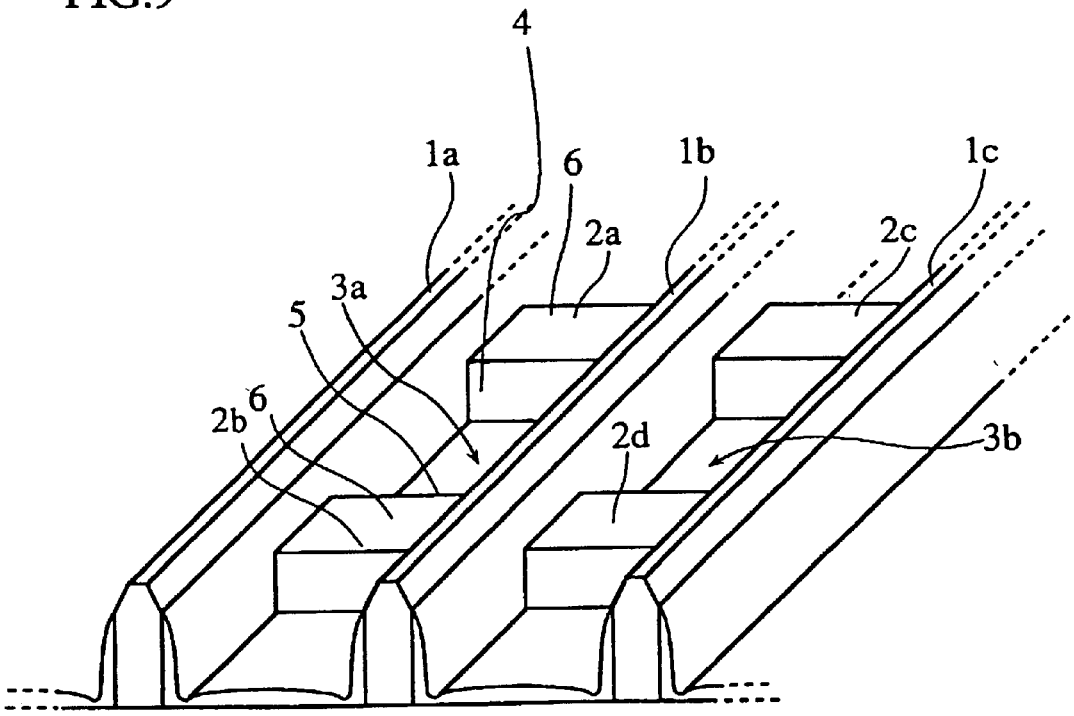
FIG. 9 is a partial perspective and sectional view of barrier ribs and auxiliary barrier ribs of a PDP.

FIG. 8 is a partial perspective and sectional view of the structure of a nozzle member 750 of the phosphor ink applying device of the second embodiment.

As shown in the figure, the nozzle member 780 is composed of a lid member 781, and a discharge member 782, and these two members are aligned and hermetically sealed together. The lid member 781 is formed of plate-shaped stainless steel, and has an opening in the center which is an induction mouth 783 for inducing phosphor ink.

The discharge member 782 is composed of an ink space 784 cut out section in the middle, three nozzle apertures 785*a, b*, and *c* opened in the bottom of the ink space, valves 786*a, b, c* partway along the nozzle apertures for changing the ink quantity and driving motors 787*a, b, c* for driving the valves. Here, the ink space, the nozzle apertures, and the space for storing the valves 786*a, b, c* are subjected to a mirror surface processing according to electrolytic polishing so that friction resistance of phosphor ink that flows through is reduced to a minimum.

A distance W along the x-axis between the nozzle apertures 785*a* and 785*b*, and the nozzle apertures 785*b* and 785*c* is formed to maintain a distance which is three times the distance between barrier ribs on the back panel. By maintaining such a distance, a plurality of blue lines for example, can be applied.

The valves 786*a, b*, and *c* are driven independently by the driving motors 787*a, b*, and *c* respectively, and the driving motors are controlled in the same manner as those in the first embodiment by the controller. Accordingly, as with the first embodiment, a plurality of phosphor inks can be applied in line-shapes and mixing of colors can be avoided even in a back panel which is intricately shaped such as that formed by auxiliary barrier ribs. In addition, a plurality of nozzle apertures are provided in one phosphor ink discharge device, therefore a more compact structure can be provided as less tanks are required.

When a plurality of nozzles are provided in this way, however, it is possible for there to be deviations of approximately 5% between the discharge quantities of the nozzle apertures, due to the precision of the processing of the nozzle aperture. However, as valves and driving devices are provided in the second embodiment, it is possible to discover the degree to which the valves should be open by experiment beforehand so that the discharge flow of each nozzle aperture is even, and if the opening of the valves is controlled so as to correct the deviations, deviations in discharge flow can be prevented.

Please note that it is possible to use only one of this kind of phosphor ink discharge device, but by providing three as in the first embodiment, the number of phosphor ink lines that can be formed simultaneously is increased while color mixing is prevented, resulting in improved work efficiency.

INDUSTRIAL APPLICATION

PDPs manufactured according the phosphor application device of the present invention are effective as display devices used in computers and televisions, and in particular display devices which demand high brightness.

What is claimed is:

1. A phosphor ink applying device for applying phosphor ink to a surface of an object, comprising:

one or more tanks for storing phosphor ink, a plurality of nozzle members, each nozzle member having at least one nozzle aperture, moving unit for moving the nozzle members, pressuring unit for applying pressure to the phosphor ink stored in any of the tanks so as to discharge the phosphor ink through the nozzle aperture, and control unit for individually controlling a discharge quantity of phosphor ink discharged through each nozzle aperture, according to a predetermined discharge flow set for each nozzle aperture.

2. The phosphor ink applying device of claim 1, wherein each nozzle member includes a discharge quantity varying unit for varying the discharge quantity through each nozzle aperture, and the control unit controls the discharge quantity of the phosphor ink by driving each discharge quantity varying unit individually.

3. The phosphor ink applying device of claim 2, wherein the nozzle members are positioned offset from each other in the direction of the nozzle movement in relation to the surface.

4. The phosphor ink applying device of claim 2, wherein the discharge quantity varying unit is a flow path resistance varying unit for varying the discharge quantity by varying the flow path resistance of the phosphor ink to the nozzle members.

5. The phosphor ink applying device of claim 1, wherein the pressuring unit includes at least one applied pressure varying unit for varying the pressure applied to the phosphor ink, and the control unit controls the discharge quantity of the phosphor ink by driving each applied pressure varying unit individually.

6. The phosphor ink applying device of claim 5, wherein the nozzle members are positioned offset from each other in the direction of the nozzle movement in relation to the surface.

7. The phosphor ink applying device of claim 1, wherein the nozzle members are positioned offset from each other in the direction of the nozzle movement in relation to the surface.

8. The phosphor ink applying device of claim 1, wherein the control unit controls the discharge quantity of phosphor ink through each nozzle aperture so as to correct the deviations in discharge flow through each nozzle aperture.

9. The phosphor ink applying device of claim 1, wherein the object is a substrate for use in a plasma display panel and has barrier ribs.

10. The phosphor ink applying device of claim 1, wherein the control means controls the discharge quantity of the phosphor ink through each nozzle aperture so as to correct any deviations in discharge flow through each nozzle aperture.

11. A phosphor ink applying device for applying phosphor ink to a surface of an object, comprising:

one or more tanks for storing phosphor ink, a plurality of nozzle members, each nozzle member having at least one nozzle aperture, moving unit for moving the nozzle members, pressuring unit for applying pressure to the phosphor ink stored in any of the tanks so as to discharge the phosphor ink through the nozzle aperture, discharge quantity varying unit for varying a discharge quantity of phosphor ink to which pressure is applied, and control unit for controlling a discharge quantity of phosphor ink discharged through each nozzle aperture, according to a predetermined discharge flow set for each nozzle aperture, by driving each discharge quantity varying unit individually.

12. The phosphor ink applying device of claim 11, wherein the nozzle members are positioned offset from each other in the direction of the nozzle movement in relation to the surface.

13. The phosphor ink applying device of claim 11, wherein the discharge quantity varying unit is a flow path resistance varying unit for varying the discharge quantity by varying the flow path resistance of the phosphor ink to the nozzle members.

14. The phosphor ink applying device of claim 13, wherein the flow path resistance varying unit includes a valve.

15. The phosphor ink applying device of claim 11, wherein the object is a substrate for use in a plasma display panel and has barrier ribs.

16. The phosphor ink applying device of claim 11, wherein the moving unit includes a slideable table for carrying the substrate, and the nozzle members are provided so as to be above grooves between the barrier ribs of the substrate.

17. The phosphor ink applying device of claim 11, wherein the control means controls the discharge quantity of the phosphor ink through each nozzle aperture so as to correct any deviations in discharge flow through each nozzle aperture.

18. The phosphor ink applying device of claim 11, wherein the control unit controls the discharge quantity of the phosphor ink through each nozzle aperture so as to correct the deviations in discharge flow through each nozzle aperture.

19. A phosphor ink applying method for applying phosphor ink to a surface of an object, comprising:

pressuring step for applying pressure to the phosphor ink stored in any of one or more tanks so as to discharge the phosphor ink through a plurality of nozzle members, each nozzle member having at least one nozzle aperture, and control step for individually controlling a discharge quantity of phosphor ink discharged through each nozzle aperture, according to a predetermined discharge flow set for each nozzle aperture.

20. The phosphor ink applying method of claim 19, wherein the phosphor ink applying method further includes a discharge quantity varying step for varying the discharge quantity through each nozzle aperture individually, and the control step controls the discharge quantity of the phosphor ink by each discharge quantity varying step individually.

21. The phosphor ink applying method of claim 20, wherein the discharge quantity varying step is a flow path resistance varying step for varying the discharge quantity by varying the flow path resistance of the phosphor ink to the nozzle members.

22. The phosphor ink applying method of claim 21, wherein the object is a substrate for use in plasma display panel and has barrier ribs.

23. The phosphor ink applying method of claim 19, wherein the control unit controls the discharge quantity of the phosphor ink through each nozzle aperture so as to correct the deviations in discharge flow through each nozzle aperture.

24. The phosphor ink applying method of claim 19, wherein the pressuring step includes at least one of applied pressure varying step for varying the pressure applied to the phosphor ink through each nozzle aperture individually, and controlling the discharge quantity of the phosphor ink by each applied pressure varying step.

25. The phosphor ink applying method of claim 24, wherein the nozzle members are positioned offset from each other in the direction of the nozzle movement in relation to the surface.

26. The phosphor ink applying method of claim 19, wherein the nozzle members are positioned offset from each other in the direction of the nozzle movement in relation to the surface.

27. The phosphor ink applying method of claim 19, wherein the control means controls the discharge quantity of the phosphor ink through each nozzle aperture so as to correct any deviations in discharge flow through each nozzle aperture.

* * * * *